US005252422A

United States Patent [19]

Okano et al.

[11] Patent Number: 5,252,422

[45] Date of Patent: Oct. 12, 1993

[54] METHOD FOR PREPARING AN ELECTROPHOTOGRAPHIC PHOTORECEPTOR

[75] Inventors: Sadao Okano; Takahiro Suzuki; Masanori Murase; Koji Bando; Seiji Ashiya, all of Kanagawa, Japan

[73] Assignee: Fuji Xerox Co., Ltd., Tokyo, Japan

[21] Appl. No.: 829,618

[22] Filed: Jan. 31, 1992

Related U.S. Application Data

[63] Continuation-in-part of Ser. No. 757,028, Sep. 9, 1991, Pat. No. 5,188,916.

[30] Foreign Application Priority Data

Oct. 8, 1990 [JP] Japan ..... 2-268315
Oct. 26, 1990 [JP] Japan ..... 2-287232
Feb. 1, 1991 [JP] Japan ..... 3-31412

[51] Int. Cl.[5] ..... G03G 5/14
[52] U.S. Cl. ..... 430/131; 430/60
[58] Field of Search ..... 430/59, 60, 62, 64, 430/131

[56] References Cited

U.S. PATENT DOCUMENTS 5,032,481 7/1991 Berwick et al. ..... 430/60
5,075,189 12/1991 Ichino et al. ..... 430/60
5,104,757 4/1992 Koyama et al. ..... 430/60

FOREIGN PATENT DOCUMENTS 59-223439 12/1984 Japan .

*Primary Examiner*—John Goodrow
*Attorney, Agent, or Firm*—Finnegan, Henderson, Farabow, Garrett & Dunner

[57] ABSTRACT

A novel method for preparing an electrophotographic photoreceptor is disclosed, which comprises laminating a charge generating layer and a charge transporting layer in this order on an electrically conductive substrate via an undercoating layer, wherein the coating solution for said undercoating layer contains an alkoxide coupling agent represented by formula (I), an aliphatic alcohol solvent containing at least the same number of carbon atoms as in the alkoxy group in said alkoxide coupling agent, and at least one compound selected from the group consisting of aromatic solvents, ethylene glycols and propylene glycols:

$$X_m—m—(OR_1)_N \quad (I)$$

wherein $R_1$ represents an alkyl group having 1 to 5 carbon atoms; M represents Si, Ti, Zr or Al; X represents an organic group; m represents an integer of 0, 1 or 2; and n represents an integer of 1 to 4, provided that when M is Si, Ti or Zr, n is an integer of 1 to 4 and m is an integer of (4−n) and when M is Al, n is an integer of 1 to 3 and m is an integer of (3−n).

1 Claim, 1 Drawing Sheet

METHOD FOR PREPARING AN ELECTROPHOTOGRAPHIC PHOTORECEPTOR

This application is continuation-in-part of U.S. patent application Ser. No. 07/757,028, filed Sept. 9, 1991 now U.S. Pat. No. 5,188,916 in the names of Masahiko Hodumi, Koji Bando, Takahiro Suzuki, Shigeto Hashiba, Yoshiyuki Ono, Sadao Okano, Seiji Ashiya, and Masanori Murase.

FIELD OF THE INVENTION

The present invention relates to a method for preparing an electrophotographic photoreceptor comprising an electrically conductive substrate, an undercoating layer, a charge generating layer and a charge transporting layer.

BACKGROUND OF THE INVENTION

In electrophotographic copying machines, copying speed has been increased year after year. In order to keep up with this technical progress, photoreceptors having a high light sensitivity and a prolonged life have been desired.

Many function-separation type electrophotographic photoreceptors comprising a plurality of members each separate functions have been proposed for improvements in electrophotographic properties such as charge retention, stability for repeated use, light response, spectral properties and mechanical strength.

These electrophotographic photoreceptors have known disadvantages in that they lack stability for repeated use or environmental stability of development contrast, they are subject to image defects such as white spot, black spot, roughness and pinhole and they exhibit so low an adhesion strength between the substrate and the light-sensitive layer that the light-sensitive layer is peeled off during use, showing insufficient durability.

In order to eliminate these disadvantages, it has been proposed to provide a resin layer as an undercoating layer between the substrate and the light-sensitive layer. As such resins there have been known polyparaxylene, casein, polyvinyl alcohol, phenol resin, polyvinyl acetal resin, melamine resin, nitrocellulose, ethylene-acrylic acid copolymer, polyamide (e.g., nylon 6, nylon 66, nylon 610, copolymer nylon, alkoxymethylated nylon), polyurethane, gelatin, polyvinyl pyrrolidone, polyvinyl pyridine, and polyvinyl methyl ether.

Further, many proposals have been made to form an undercoating layer from zirconium chelate compounds, organic zirconium compounds such as zirconium alkoxide or silane coupling agents as described in JP-A-59-223439, 61-94057, and 62-273549 (the term "JP-A" as used herein means an "unexamined published Japanese patent application").

In the case where a resin layer is provided as an undercoating layer, a resin containing a relatively large amount of polar groups is mainly incorporated therein so that the volume resistivity thereof is controlled to a low level to such an extent that the electrophotographic properties are not deteriorated. However, since the volume resistivity of a resin greatly depends on the ionic conductivity and is thus extremely affected by temperature and humidity, the resin layer under low temperature and humidity or high temperature and humidity conditions exhibits a remarkably high resistivity which deteriorates the electrophotographic properties of the light-sensitive layer or a remarkably low resistivity which eliminates the desired functions of the resin layer.

Therefore, the above mentioned known resin layer can eliminate only some of the disadvantages of photoreceptors. If environmental properties are included, the effects of this approach are halved. Thus, this approach is extremely insufficient.

On the other hand, when zirconium chelate compounds, organic zirconium compounds such as zirconium alkoxide or silane coupling agents are used, the above mentioned problems can be considerably but not sufficiently eliminated. That is, these coupling agents undergo heat hardening reaction to form a film. However, if the heat hardening reaction does not sufficiently proceed, there occurs some difference in the wetting characteristics of the surface of the thin coating film which can cause a remarkable unevenness in the thickness of the thin coating film laminated with a light-sensitive layer, particularly a charge generating layer which needs to be thin, resulting in some unevenness and fog on copied images. The wetting characteristics of the surface of the coating film also change with time and thus make it very difficult to provide a charge generating layer with a uniform thickness.

As mentioned above, the conventional undercoating layer is insufficient as an undercoating layer for eliminating various disadvantages of photoreceptors. Further, the properties of the conventional electrophotographic photoreceptors are insufficient.

SUMMARY OF THE INVENTION

An object of the present invention is to provide an electrophotographic photoreceptor which does not suffer from the change in the thickness of a charge generating layer laminated therewith with time and exhibits a stable uniformity in film thickness by the use of an undercoating layer coating solution with an improved stability containing an alkoxide coupling agent.

The above and other objects of the present invention will become more apparent from the following detailed description and examples.

As a result of studies, the inventors found that a coating solution comprising in combination a specific alkoxide coupling agent and a specific solvent exhibits an improved stability and the above object of the present invention can be accomplished by the use of such a coating solution. Thus, the present invention was worked out.

That is, the above object of the present invention is accomplished by a method for preparing an electrophotographic photoreceptor which comprises laminating a charge generating layer and a charge transporting layer in this order on an electrically conductive substrate via an undercoating layer, wherein a coating solution for said undercoating layer contains an alkoxide coupling agent represented by formula (I), an aliphatic alcohol solvent containing at least the same number of carbon atoms as in the alkoxy group in said alkoxide coupling agent, and at least one compound selected from the group consisting of aromatic solvents, ethylene glycols and propylene glycols:

$$X_m—M—(OR_1)_N \quad (I)$$

wherein $R_1$ represents an alkyl group having 1 to 5 carbon atoms; M represents Si, Ti, Zr or Al; X represents an organic group; m represents an integer of 0, 1 or 2; and n represents an integer of 1 to 4, provided that when M is Si, Ti or Zr, n is an integer of 1 to 4 and m is an integer of (4−n) and when M is Al, n is an integer of 1 to 3 and m is an integer of (3−n).

BRIEF DESCRIPTION OF THE DRAWING

By way of example and to make the description more clear, reference is made to the accompanying drawing in which.

DETAILED DESCRIPTION OF THE INVENTION

Figure 1:
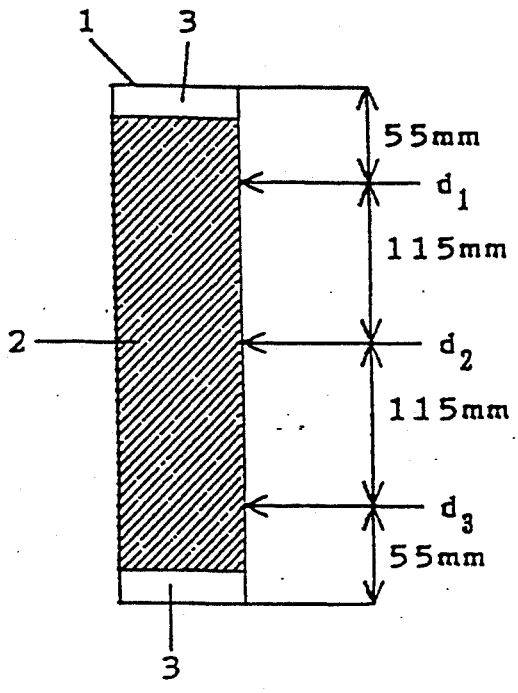
FIG. 1 is a diagrammatic plan view of an electrophotographic photoreceptor of the present invention wherein Numeral 1 represents an aluminum pipe, Numeral 2 represents a charge generating layer and Numeral 3 represents an uncoated portion at both edges.

The present invention will be further described hereinafter.

In the formula (I), X represents an organic group such as a acetyl acetone group, a γ-amino group and a vinyl group; M represents preferably Si, Ti or Zr and more preferably Zr; $R_1$ represents an alkyl group having 1 to 5 carbon atoms such as a methyl group, an ethyl group, a propyl group a butyl group and a pentyl group.

The electrophotographic photoreceptor of the present invention is formed by coating a coating solution for an undercoating layer, a coating solution for a charge generating layer and a coating solution for a charge transporting layer in this order on an electrically conductive substrate.

An electrically conductive substrate, well-known materials may be used. Preferred examples of such known materials include aluminum and stainless steel.

The undercoating layer is formed by coating the electrically conductive substrate with a coating solution comprising the above mentioned alkoxide coupling agent and aliphatic alcohol solvent. The aliphatic alcohol solvent is preferably used in an amount of 50 to 95 wt % based on the alkoxide coupling agent. Examples of such an alkoxide coupling agent which can be used in the present invention include silane coupling agents represented by formula (I), titanium coupling agents, zirconium coupling agents, and aluminum coupling agents. Specific examples of these alkoxide coupling agents will be set forth hereinafter.

Examples of silane coupling agents include vinyl trimethoxy silane, vinyl triethoxy silane, vinyl tris-2-methoxyethoxy silane, vinyl triacetoxy silane, γ-glycidoxy propyl trimethoxy silane, γ-methacryloxy propyl trimethoxy silane, γ-aminopropyl triethoxy silane, γ-chloropropyl trimethoxy silane, γ-2-aminoethyl aminopropyl trimethyl silane, γ-mercaptopropyl trimethoxy silane, γ-ureidopropyl triethoxy silane, and β-3,4-epoxycyclohexyl ethyltrimethoxy silane. Further, alkyl(phenyl)alkoxy silane and alkyl silicate can be used.

Examples of titanium coupling agents include tetrapropoxy titanium, tetrabutoxy titanium, dibutoxy titanium-bis(octylene glycolate), dipropoxy titanium-bis(ethylacetyl acetate), and dipropoxy titanium-bis(triethanolaminate).

Examples of zirconium coupling agents include zirconium dipropoxydiacetyl acetonate, tributoxy zirconium acetyl acetonate, and tetraalkoxy zirconium.

Examples of aluminum coupling agents include aluminum isopropylate, aluminum diisopropoxy monoethyl acetate, aluminum-n-butoxide monomethyl acetate, aluminum diisobutoxy monomethyl acetate, and aluminum di-n-butoxy monoethyl acetoacetate.

Among the above alkoxide coupling agents, γ-aminopropyl triethoxy silane and tributoxy zirconium acetyl acetonate are preferred.

These alkoxide coupling agents can be used, singly or in admixture.

As solvent for dissolving the above mentioned alkoxide coupling agent, an aliphatic alcohol solvent may be used in the present invention. Alternatively, aromatic hydrocarbons such as toluene, esters such as ethyl acetate and cellosolve acetate, etc may be used. However, if these solvents are used, the resulting coating solution is subject to whitening or gelation if it is allowed to stand at room temperature and thus cannot be used as a stable coating solution. Therefore, aliphatic alcohol solvents need to be used in the present invention.

Some aliphatic alcohol solvents undergo substitution reaction with the alkoxy group in the above mentioned alkoxide coupling agent. For example, when a coating solution for an undercoating layer is dip-coated on an electrically conductive substrate, and then heat-dried to form an undercoating layer thereon, such a solvent undergoes substitution reaction to change the alkoxy group in the alkoxide coupling agent. This causes a problem that the surface characteristics (wetting characteristics) of the undercoating layer show a change that makes it impossible to form a uniform charge generating layer thereon. This phenomenon can be inhibited by using an alcohol containing at least the same number of carbon atoms as in the alkoxy group in the alkoxide coupling agent so that even if substitution reaction occurs, the alkoxy group in the alkoxide coupling agent does not change, or substitution reaction can be inhibited. Therefore, in the present invention, as such an aliphatic alcohol solvent, a solvent containing at least the same number of carbon atoms as in the alkoxy group in the alkoxide coupling agent is necessarily used. In particular, aliphatic alcohols containing alkyl group which causes a high steric hindrance may be advantageously used.

Examples of solvents suitable for this purpose include methanol, ethanol, 1-propanol, 2-propanol, 1-butanol, 2-butanol, 1-pentanol, 2-pentanol, and 3-pentanol. In the present invention, any compounds selected from these solvents can be used.

As aromatic solvents, toluene, xylene, benzene, chlorobenzene, etc. can be used. As ethylene glycols and propylene glycols there can be used ethylene glycol monomethyl ether, ethylene glycol monomethyl ether acetate, propylene glycol monomethyl ether, propylene glycol monomethyl ether acetate, diethylene glycol butyl ether acetate, dipropylene glycol methyl ether acetate, etc. The reason for the incorporation of these solvents in the alcohol solvent is thought to be the incorporation of these aromatic solvents, ethylene glycols and propylene glycols in the coating solvent provides an effect of preventing the alkoxide coupling agent from polymerization and deposition in the coating solution or an effect of keeping an oligomer, if produced by the polymerization of the alkoxide coupling agent in the solution, dissolved in the solution to some extent so that the whitening of the solution can be inhibited. Among the above aromatic solvents, ethylene glycols and propylene glycols, aromatic solvents such as toluene, xylene, benzene and chlorobenzene are preferred.

The above solvents are preferably used in an amount of 10 to 90 wt % based the aliphatic alcohol solvents.

The undercoating layer can be formed by coating on an electrically conductive substrate a coating solution for an undercoating layer by any suitable coating method such as a dip coating method, a spray coating method, a blade coating method, a spinner coating method, a bead coating method and a curtain coating method, and then heat-drying the material. For drying of the coat film, an air blow drying or a stationary drying can be effected at a temperature of 100° to 250° C., preferably 120° to 200° C. and more preferably 135° to 180° C. for 5 minutes to 6 hours, preferably 5 minutes to 2 hours and more preferably 7 minutes to 15 minutes. The film thickness is normally in the range of 0.1 to 5 μm and preferably 0.05 to 1 μm.

On the undercoating layer is provided a light-sensitive layer. In order to best attain the features of the present invention, a structure is preferably used which comprises a charge generating layer and a charge transporting layer sequentially laminated in this order on the undercoating layer. This structure is particularly suitable when the formation of a charge generating layer with a uniform thickness is desired.

The charge generating layer may be formed by dispersing a charge generating substance in a binder resin. Examples of such a charge generating substance include selenium, a selenium alloy, an inorganic photoconductive substance such as CdS, CdSe, CdSSe, ZnO and ZnS, a metal or metal-free phthalocyanine pigment, an azo pigment such as bisazo pigment and triazo pigment, a squarium compound, an azlenium compound, a perylene pigment, an indigo pigment, a quinacridone pigment, a polycyclic quinone pigment, a cyanine dye, a xanthene dye, charge transfer complex made of poly-N-vinylcarbazole and trinitrofluorenone, etc., and an eutectic complex made of pyrylium salt dye and polycarbonate resin, etc.

As binding resin, there can be used any known binder resin such as polycarbonate, polystyrene, polyester, polyvinyl butyral, methacrylic ester polymer or copolymer, acetic vinyl polymer or copolymer, cellulose ester or ether, polybutadiene, polyurethane and epoxy resin.

The charge transporting layer may be mainly composed of a charge transporting substance. The charge transporting substance is not specifically limited. As such a substance there can be used any substance transparent to visible light capable of transporting electric charge. Specific examples of such a substance include imidazole, pyrazoline, thiazole, oxadiazole, oxazole, hydrazine, ketazine, azine, carbazole, polyvinyl carbazole, derivative thereof, triphenylamine derivative, stilbene derivative, and benzidine derivative. As necessary, such a substance can be used in combination with a binder resin. Examples of such a binder resin include polycarbonate, polyarylate, polyester, polystyrene, styrene-acrylonitrile copolymer, polysulfone, polymethacrylic ester, and styrenemethacrylic ester copolymer.

The present invention will be further described in the following examples, but the present invention should not be construed as being limited thereto.

EXAMPLE 1

| | |
|---|---|
| 50% Toluene solution of tributoxyzirconium acetyl acetonate ("ZC540" manufactured by Matsumoto Kosho K.K.) | 100 parts by weight |
| γ-Aminopropyl trimethoxy silane ("A111" manufactured by Nihon Unicar K.K.) | 11 parts by weight |
| n-Butyl alcohol | 500 parts by weight |

The above mentioned components were stirred by a stirrer to prepare an undercoating layer coating solution. The coating solution was dip-coated on the surface of an aluminum cylinder having a diameter of about 84 mm and a length of 340 mm, and then heat-dried at a temperature of about 150° C. for about 7.5 minutes to form an undercoating layer with a thickness of about 0.1 μm thereon.

87 parts by weight of granular trigonal selenium and a solution of 13 parts by weight of a vinyl chloridevinyl acetate copolymer ("Solution Vinyl VMCH" manufactured by Union Carbide) dissolved in 200 parts by weight of n-butyl acetate were dispersed by means of an attritor for 24 hours. 30 parts by weight of the thus obtained dispersion were then diluted with 57 parts by weight of n-butyl acetate to obtain a dip coating solution.

The dip coating solution was dip-coated on the undercoating layer coated on the aluminum cylinder at a coating rate of 110 mm/min, and then dried at a temperature of 100° C. for 5 minutes to form a charge generating layer thereon. The thus-obtained charge generating layer thickness was then determined by measuring as shown in FIG. 1. Numerals 1, 2 and 3 in FIG. 1 represent an aluminum pipe, a charge generating layer and an uncoated portion at both edges of the pipe, respectively. Measurement points $d_1$, $d_2$ and $d_3$ are positioned at 55 mm, 170 mm and 285 mm from the top of the aluminum pipe, respectively. A coating solution for an undercoating layer and a coating solution for a charge generating layer were then used to determine the change in the film thickness at the various measurement points with time (relative change in the film thickness with time) in the same manner as described above. The results are shown in Table 1.

EXAMPLES 2 to 7 & COMPARATIVE EXAMPLES 1 to 8

An undercoating layer and a charge generating layer were sequentially laminated on the surface of an aluminum cylinder in this order in the same manner as in Example 1 except that the kind and proportion of alkoxide coupling agents and aliphatic alcohol solvents were altered as shown in Table 1. The results of the change in the thus-obtained charge generating layer with time (relative change in the film thickness with time) are shown in Tables 1 and 2.

TABLE 1

| Example | Coupling agent (part by weight) | | Organic sovlent (part by weight) | | * | Film thickness change with time after preparation of solution (Relative value) % 1 day | 3 days | 10 days | 30 days | 60 days |
|---|---|---|---|---|---|---|---|---|---|---|
| Example 1 | ZC540 | 100 | 1-Butanol | 500 | d1 | 100 | 98 | 102 | 103 | 104 |
| | A1110 | 11 | | | d2 | 100 | 99 | 103 | 103 | 105 |
| | | | | | d3 | 100 | 101 | 103 | 103 | 105 |
| Example 2 | ZC540 | 100 | 1-Pentanol | 500 | d1 | 100 | 99 | 100 | 102 | 103 |
| | A1110 | 11 | | | d2 | 100 | 102 | 101 | 103 | 104 |

TABLE 1-continued

| Example | Coupling agent (part by weight) | | Organic sovlent (part by weight) | | * | Film thickness change with time after preparation of solution (Relative value) % 1 day | 3 days | 10 days | 30 days | 60 days |
|---|---|---|---|---|---|---|---|---|---|---|
| | | | | | d3 | 100 | 101 | 101 | 102 | 105 |
| Example 3 | ZC540 | 90 | 1-Butanol | 450 | d1 | 100 | 100 | 101 | 102 | 102 |
| | KBM503 | 11 | | | d2 | 100 | 103 | 99 | 104 | 103 |
| | | | | | d3 | 100 | 101 | 102 | 103 | 103 |
| Example 4 | ZC540 | 100 | t-Butanol | 420 | d1 | 100 | 102 | 101 | 102 | 102 |
| | | | | | d2 | 100 | 99 | 99 | 101 | 104 |
| | | | | | d3 | 100 | 98 | 101 | 104 | 104 |
| Example 5 | ZA60 | 50 | t-Butanol | 500 | d1 | 100 | 95 | 97 | 100 | 98 |
| | KBM503 | 10 | Xylene | 50 | d2 | 100 | 96 | 97 | 99 | 97 |
| | | | | | d3 | 100 | 96 | 99 | 98 | 97 |
| Example 6 | ZA60 | 50 | 1-Butanol | 200 | d1 | 100 | 102 | 104 | 105 | 106 |
| | KBM503 | 10 | 2-Propanol | 350 | d2 | 100 | 101 | 105 | 103 | 105 |
| | | | Propylene glycol methyl ether acetate | 10 | d3 | 100 | 102 | 106 | 106 | 107 |
| Example 7 | ZC540 | 50 | 1-Butanol | 500 | d1 | 100 | 101 | 104 | 105 | 104 |
| | TC-100 | 30 | | | d2 | 100 | 103 | 105 | 106 | 106 |
| | | | | | d3 | 100 | 102 | 104 | 105 | 107 |

*Determined relative to the thickness at each measurement point measured on 1 day after the preparation of the solution

TABLE 2

| Example | Coupling agent (part by weight) | | Organic sovlent (part by weight) | | * | Film thickness change with time after preparation of solution (Relative value) % 1 day | 3 days | 10 days | 30 days | 60 days |
|---|---|---|---|---|---|---|---|---|---|---|
| Comparative Example 1 | ZC540 | 100 | Methanol | 500 | d1 | 100 | 105 | 106 | 108 | 110 |
| | A1110 | 11 | | | d2 | 100 | 112 | 115 | 117 | 119 |
| | | | | | d3 | 100 | 114 | 118 | 120 | 124 |
| Comparative Example 2 | ZC540 | 100 | Ethanol | 200 | d1 | 100 | 107 | 109 | 115 | 115 |
| | A1110 | 11 | Methanol | 300 | d2 | 100 | 114 | 124 | 124 | 125 |
| | | | | | d3 | 100 | 115 | 124 | 127 | 130 |
| Comparative Example 3 | ZC540 | 90 | Methanol | 500 | d1 | 100 | 105 | 108 | 114 | 116 |
| | KBM503 | 11 | | | d2 | 100 | 117 | 126 | 130 | 131 |
| | | | | | d3 | 100 | 119 | 130 | 134 | 137 |
| Comparative Example 4 | ZC540 | 100 | Ethanol | 500 | d1 | 100 | 101 | 106 | 108 | 111 |
| | | | | | d2 | 100 | 106 | 116 | 120 | 126 |
| | | | | | d3 | 100 | 109 | 119 | 132 | 134 |
| Comparative Example 5 | ZC540 | 100 | 2-Propanol | 500 | d1 | 100 | 103 | 106 | 107 | 108 |
| | | | | | d2 | 100 | 107 | 109 | 118 | 128 |
| | | | | | d3 | 100 | 109 | 117 | 123 | 128 |
| Comparative Example 6 | ZA60 | 90 | Ethanol | 200 | d1 | 100 | 105 | 107 | 109 | 112 |
| | KBM503 | 10 | Methanol | 300 | d2 | 100 | 108 | 122 | 124 | 125 |
| | | | | | d3 | 100 | 110 | 125 | 130 | 133 |
| Comparative Example 7 | ZC540 | 50 | Ethanol | 500 | d1 | 100 | 103 | 106 | 107 | 110 |
| | TC-100 | 30 | | | d2 | 100 | 115 | 121 | 128 | 131 |
| | | | | | d3 | 100 | 114 | 126 | 132 | 135 |
| Comparative Example 8 | ZC540 | 50 | 1-Propanol | 200 | d1 | 100 | 109 | 112 | 116 | 118 |
| | TC-100 | 30 | Ethanol | 300 | d2 | 100 | 120 | 128 | 130 | 132 |
| | | | | | d3 | 100 | 122 | 129 | 134 | 137 |

*Determined relative to the thickness at each measurement point measured on 1 day after the preparation of the solution ZC540: 50% toluene solution of tributoxy zirconium acetyl acetonate (manufactured by Matsumoto Kosho K.K.)

A1110: γ-Aminopropyl triethoxy silane (manufactured by Nihon Unicar K.K.)

KBM503: γ-Methacryloxy propyl trimethoxy silane (manufactured by The Shin-etsu Chemical Industry Co., Ltd.)

ZA60: Zirconium tetra-n-butoxide (manufactured by Matsumoto Kosho K.K.)

ZA50: Zirconium isopropoxide (manufactured by Matsumoto Kosho K.K.)

TC-100: Dipropyloxy titanium acetyl actonate (manufactured by Matsumoto Kosho K.K.)

The coating solution for an undercoating layer prepared according to the present invention exhibits an excellent stability, can be uniformly coated, and shows no change in the wetting characteristics upon coating, making it possible to form a charge generating layer with a uniform thickness thereon. Accordingly, the electrophotographic photoreceptor prepared according to the present invention exhibits stable electrophotographic properties against environmental conditions such as temperature and humidity.

While the invention has been described in detail and with reference to specific embodiments thereof, it will be apparent to one skilled in the art that various changes and modifications can be made therein without departing from the spirit and scope thereof.

What is claimed is:

1. A method for preparing an electrophotographic photoreceptor which comprises laminating a charge generating layer and a charge transporting layer in this order on an electrically conductive substrate via an undercoating layer, wherein the coating solution for said undercoating layer contains an alkoxide coupling agent represented by formula (I), an aliphatic alcohol solvent containing at least the same number of carbon atoms as in the alkoxy group in said alkoxide coupling agent, and at least one compound selected from the group consisting of aromatic solvents, ethylene glycols and propylene glycols:

$$[X_m—M—(OR_1)_n]\ X_m—M—(OR_1)_n \quad (I)$$

wherein $R_1$ represents an alkyl group having 1 to 5 carbon atoms; M represents Si, Ti, Zr or Al; X represents an organic group; m represents an integer of 0, 1 or 2; and n represents an integer of 1 to 4; provided that when M is Si, Ti or Zr, n is an integer of 1 to 4 and m is an integer of (4−n) and when M is Al, n is an integer of 1 to 3 and m is an integer of (3−n).

* * * * *

UNITED STATES PATENT AND TRADEMARK OFFICE

CERTIFICATE OF CORRECTION

PATENT NO. : 5,252,422

DATED : October 12, 1993

INVENTOR(S) : Sadao Okano et al.

It is certified that error appears in the above-indentified patent and that said Letters Patent is hereby corrected as shown below:

Claim 1, column 9, line 3, formuala (I), delete "[Xm-M($OR_1$)n].

On the Title Page:

Abstract, line 13, in formula (I), "Xm-m-$(OR_1)_N$".

to --$X_m$-M-$(OR_1)_n$--.

In the specification, column 2, line 63, change "$X_m$-M-$(OR_1)_N$".

to --$X_m$-M-$(OR_1)_n$--.

Signed and Sealed this

Twenty-third Day of August, 1994

*Attest:*

*Attesting Officer*

BRUCE LEHMAN

*Commissioner of Patents and Trademarks*